US007018075B2

(12) United States Patent
Rodgers et al.

(10) Patent No.: US 7,018,075 B2
(45) Date of Patent: Mar. 28, 2006

(54) PROTECTIVE OVERHEAD LIGHT FIXTURE KIT

(75) Inventors: Frank J. Rodgers, Chicora, PA (US); John P. Malinski, Butler, PA (US)

(73) Assignee: Rodgers Holdings, Butler, PA (US)

( * ) Notice: Subject to any disclaimer, the term of this patent is extended or adjusted under 35 U.S.C. 154(b) by 42 days.

(21) Appl. No.: 10/835,739

(22) Filed: Apr. 30, 2004

(65) Prior Publication Data

US 2004/0240211 A1 Dec. 2, 2004

Related U.S. Application Data

(60) Provisional application No. 60/467,024, filed on May 2, 2003.

(51) Int. Cl.
*F21V 13/10* (2006.01)

(52) U.S. Cl. ..... 362/344; 362/376; 362/374; 362/449

(58) Field of Classification Search ..... 362/376, 362/378, 344, 354, 374, 449, 456
See application file for complete search history.

(56) References Cited

U.S. PATENT DOCUMENTS 835,475 A * 11/1906 Russell ..... 362/255
914,190 A * 3/1909 Russell ..... 362/378
6,247,832 B1 * 6/2001 Neustadt ..... 362/356

* cited by examiner

*Primary Examiner*—Renee Luebke
*Assistant Examiner*—Julie A. Shallenberger
(74) *Attorney, Agent, or Firm*—McKay & Associates, P.C.

(57) ABSTRACT

A protective overhead light fixture kit is provided for use on an overhead light fixture having an electrical housing and a dome-shaped reflector. The kit includes a grid member, a band, two or more extension springs and a lanyard member. The grid member is situated generally across the open end of the reflector. The band member is placed generally around the outer perimeter of the light fixture reflector. The extension springs include two connection means where one of the connection means is capable of attachment to and outer portion of the grid member and the other of the connection means is capable of attachment to the band. The lanyard member also includes two ends where one end is capable of attachment to the outer portion of the grid member and the other end is capable of attachment to the band. This kit when installed can convert an unprotected overhead light fixture to a protected overhead light fixture.

15 Claims, 2 Drawing Sheets

PROTECTIVE OVERHEAD LIGHT FIXTURE KIT

SPECIFIC REFERENCE

This invention hereby claims priority to provisional application Ser. No. 60/467,024 filed on May 2, 2003.

FIELD OF THE INVENTION

This invention relates generally to light fixture structures for use in an overhead mounting assembly, and more particularly pertains to a protective overhead light fixture kit utilizing a grid member, a band and two or more extension springs.

BACKGROUND OF THE INVENTION

It is common practice in a manufacturing or industrial environment to provide overhead light fixtures arranged in a pattern to assure illumination of a wide work area there beneath. Other open areas requiring overhead fixtures include gymnasiums or the like. Spaced apart light fixtures are connected in a suspension arrangement on overhead cross beams or other fixed infrastructure with each assembly having a box-like base defining a central downwardly facing socket for supporting a high wattage light bulb. Fastened to the under surface of the box and circumjacent the light bulb is a pan-like dome-shaped reflector which spreads outwardly in a downward direction toward its circular lower edge. The reflector is disposed to direct light from the light bulb in a spreading pattern that uniformly illuminates a broad work area.

A light fixture assembly of the type described requires periodic servicing, particularly because the usable life of the light bulb is limited. It is not uncommon for such a light bulb to shatter during use such that glass shards from the light bulb body are scattered down upon the work area and upon workers and machinery located in the fragment path. Depending upon the nature of the work activity being performed subjacent the light fixture, tools or equipment components often strike the light fixture from below and will often smash the light bulb so that replacement is required.

SUMMARY OF THE INVENTION

This invention comprehends the provision of a safety device or assembly capable of functioning as a removable barrier to substantially contain or slow the fall of the glass fragments of a shattered light bulb and to deflect any object moving generally upwardly against the reflector and thus prevent smashing of the light bulb by the object. Specifically the light fixture kit includes a circular planar wire cloth grid member provided with means for normally retaining it in an installed position across the lower open end of the reflector. The wire cloth is formed as a rigid member from parallel spaced apart rods and extends across the area defined by the peripheral outer reflector rim. An adjustable flexible band is provided for placement at a uniform parallel distance from the reflector's lower peripheral edge around the outer perimeter surface of the reflector, and two or more extension springs are provided for mounting in a spaced apart arrangement about the outer surface of the reflector. The extension springs each have two connection means, which are used to connect the flexible band to an outer rim portion of the wire cloth grid member. In addition, a lanyard member is provided to extend from a point on the band to a point on or near the outer edge of the grid member so that when the extension springs are disconnected at their lower ends from the grid member, the grid member is retained by the lanyard member in a hanging disposition below and from the lower edge of the reflector.

The wire cloth grid member normally serves not only as a catch surface across the lower end of the reflector such that the larger fragments of a shattered light bulb will be retained within the area defined by the reflector, but, perhaps more critically, as a barrier to deflect items moving generally upwardly toward the light fixture and which otherwise would strike and shatter the light bulb. The rigid or semi-rigid rods which form the wire cloth grid member are spaced such that open areas are defined there between to enable light reflected from the light bulb to be broadcast downwardly to and through the openings to illuminate the work area beneath the light fixture.

The present invention can be generally defined as a protective overhead light fixture kit comprising a flexible adjustable band capable of placement around the outside perimeter of an overhead light fixture reflector and a grid member comprised of spaced apart intersecting rods terminating at their various ends by jointure with a peripheral outer rim of the grid member. The invention further includes two or more extension springs, each having two connection means, for connecting the band to an outer portion of the grid member. A lanyard member is also provided which has a lower end capable of attachment to the grid member and an upper end capable of attachment to the band. Generally, the protective overhead light fixture kit is capable of converting an overhead light fixture into a protective overhead light fixture.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated kit assembly, and such further applications of the principles of the invention illustrated herein, as would normally occur to persons skilled in the art to which the invention relates. This detailed description of this invention is not meant to limit the invention, but is meant to provide a detailed disclosure of the best mode of practicing the invention.

The structure illustrated in FIGS. 1 through 5 of the drawings should be considered as it would appear in an industrial or factory location, mounted overhead above a work area. The structures illustrated in FIGS. 1 through 5 of the drawings should also be considered in any type of environment in which a light fixture would require or benefit from the present invention, including but not limited to a gymnasium or other sports arena/complex.

Figure 1:
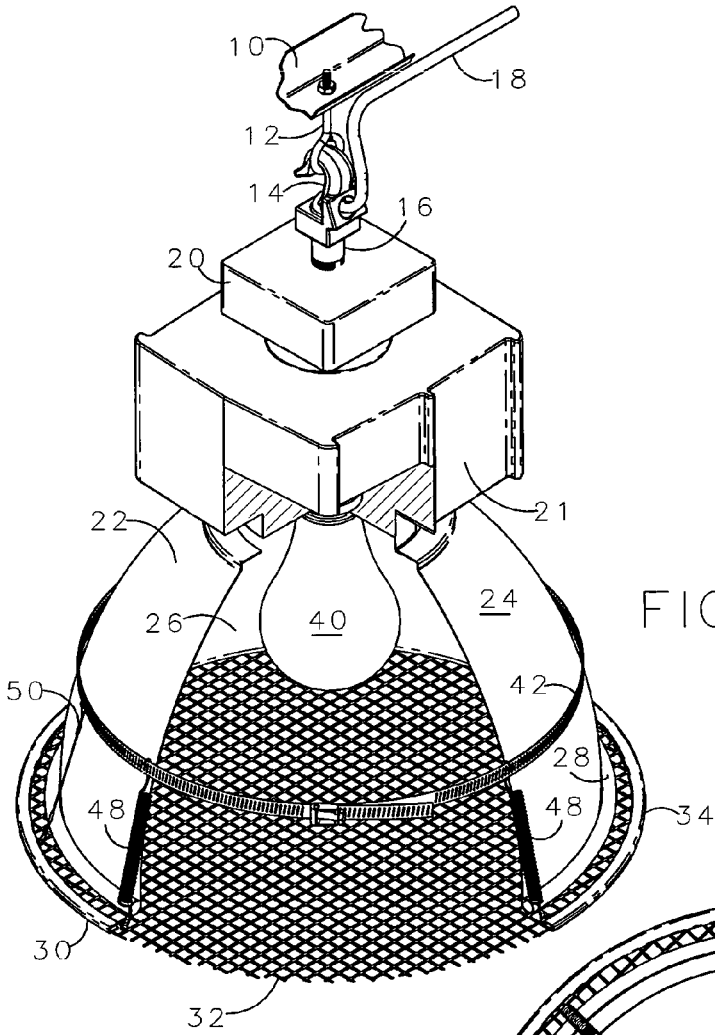
FIG. 1 is a side perspective view of a light fixture kit assembly in accordance with the present invention, having part of its structure shown cut away to reveal details of the kit assembly.
Figure 2:
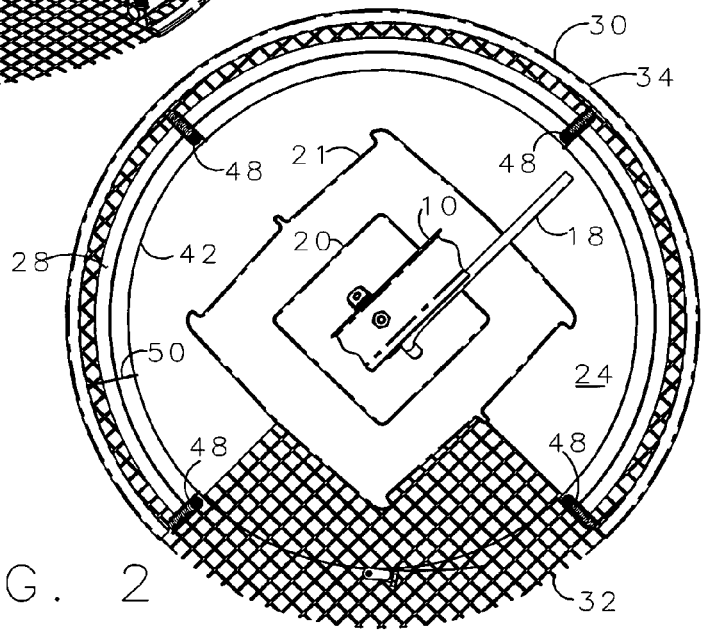
FIG. 2 is a top plan view of the kit assembly first shown in FIG. 1.

FIG. 1 illustrates a fixed cross beam 10 to which is mounted a downwardly projecting eye hook 12. The upper end of the illustrated light fixture assembly is an open hook 14 engaged to the eye of the eye hook 12. Below the hook 14 is a conduit section 16 through which extends an electrical cable 18. The conduit 16 extends into a central opening in a ballast housing 20. Any other type of housing that mounts to a beam, overhead structure or ceiling would suffice to support the present invention, and the specific example given is not intended to limit this invention. Mounted to the underside of the ballast housing 20 is an electrical housing 21 which serves as a mounting member for a reflector 22. The electrical housing 21 includes a downwardly facing light bulb socket adapted to accept a light bulb.

Figure 3:
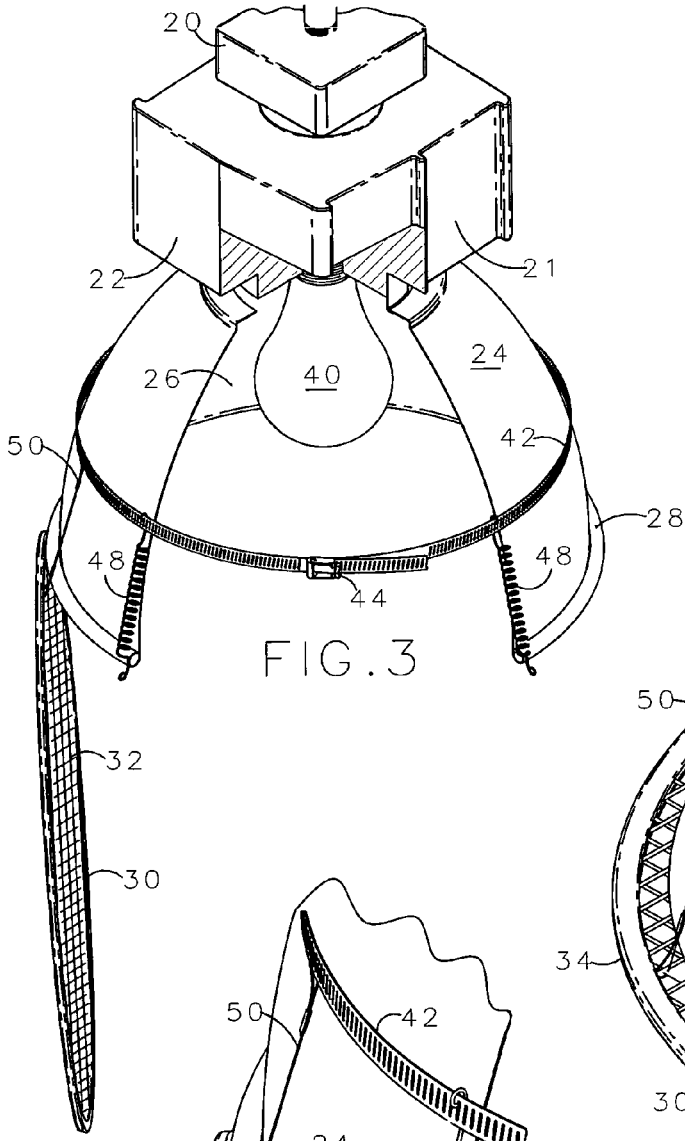
FIG. 3 is a side perspective view of the light fixture kit assembly shown in FIG. 1, but here illustrating repositioning of certain components in accordance with the use of the present invention.
Figure 5:
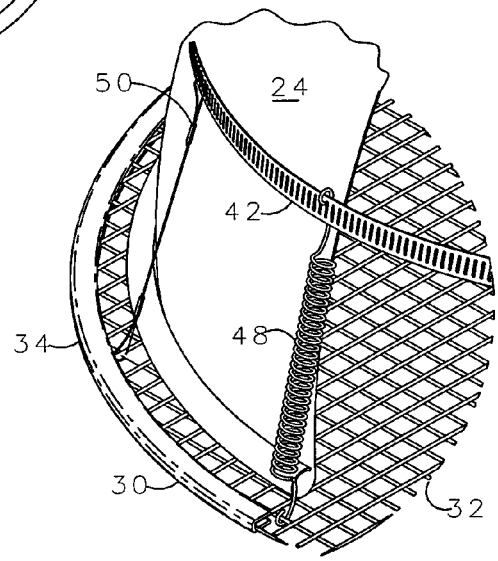
FIG. 5 is a view similar to FIG. 4 except illustrating the repositioning of certain components of the structure in accordance with the function of the present invention.

The reflector 22 has an outside surface 24 and an inside reflective surface 26. The substantially wide and open lower end of the reflector 22 has a rolled rim portion 28, against the underside of which is disposed a screen-like, wire cloth grid member 30 formed from appropriately spaced rods 32 terminating at their various ends by jointure with the peripheral circular outer rim 34. Disposed within the reflector 22 is a high intensity discharge light bulb 40 which projects downwardly from a socket in the underside of the electrical housing 21. About the outer perimeter surface of the reflector 22 at an intermediate disposition is an adjustable flexible metal band 42, the length which may be selectively adjusted by manipulation of a connector 44 as shown in FIG. 3. The band 42 can also be made of any heat resistant material. Further, the band connector 44 can be eliminated, if desired.

FIGS. 1 and 3 also illustrate two or more extension springs 48, each having two connection means. The connection means of the extension springs 48 allow for connection of the grid member 30 to the band 42 at spaced-apart locations along the band 42. The upper connection means of each extension spring 48 is releasably attached to the band 42 and the lower connection means of each extension spring 48 is releasably attached to the grid member 30 either on the outer edge 34 or at a location proximate to the outer edge 34.

As a further embodiment, also extending downwardly from a point along the band 42 is a lanyard member 50. The lanyard member has an upper and lower attachment means, the lower of which is connected to the outer rim 34 of the wire cloth grid member 30 or portion of the wire cloth grid member 30 proximate to the outer rim 34 and the upper of which is connected to the band. When the grid member 30 is released from the extension springs 48, as shown in FIG. 3, the lanyard member 50 serves to retain the grid member 30 in a downwardly projecting disposition as shown. Optionally, in the embodiment without the lanyard member, at least one extension spring can be left in an attached position during light bulb change out in order to retain the grid member in a hanging disposition.

Figure 4:
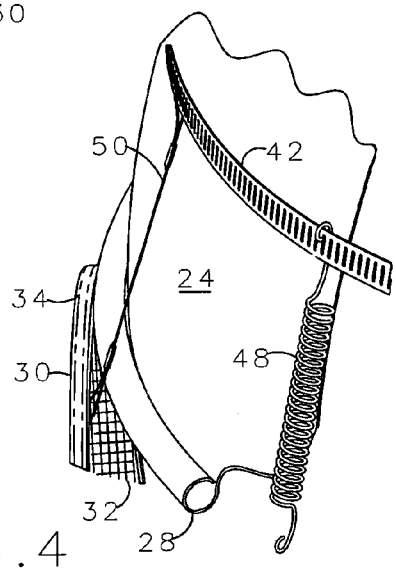
FIG. 4 is a partial or fragmentary view taken along the left side of the kit assembly shown in FIG. 3.

FIG. 4 illustrates the interconnection of each extension spring 48 with the band 42, and the interconnection of the lanyard member 50 between the band 42 and the outer rim 34 of the grid member 30. The layout of the various connections in regard to the extension springs 48 and lanyard member 50 are shown in greater detail in FIG. 5. It should be understood that the extension springs 48 are disposed in a spaced apart arrangement about the outer surface of the reflector 22 so that there is a uniform gripping action exerted between the band 42 and the outer portion of the grid member 30.

For a light fixture assembly of the type shown in the drawings, a kit may be provided comprising the wire cloth grid member 30 in an appropriate diametric size, the band 42, the lanyard member 50, and two or more extension springs 48, whereby an open unprotected reflector fixture may be selectively converted to a more desirable protective arrangement by attachment of the grid member 30 in a position across the open lower end of the reflector 22, using the extension springs 48, band 42 and optionally, the lanyard member 50 as shown in FIG. 1.

To install the protective overhead light fixture kit, first the band is placed around the outer perimeter of the reflector. If the band is provided with an adjustable connector it is used to secure the band around the outer perimeter of the reflector. Then the grid member is held over the lower open end of the reflector. Two or more extension springs are then connected to the band and an outer portion of the grid member to secure the grid member to the reflector. The lanyard member is then optionally connected by one attachment means to the band and by the other attachment means to an outer portion of the grid member. The lanyard member can be eliminated from the kit, if desired. In this instance at least one extension spring will remain in the attached position during light bulb change out to prevent the grid member 30 from detaching from the reflector 22.

When the protective overhead light fixture kit is installed, objects moving toward or propelled against the underside of the protected light fixture will then be deflected away from the light bulb 40, and larger fragments of an exploded or shattered light bulb will be retained on the grid member 30 and substantially within the area defined by the reflector until safe manual removal of the fragments can be accomplished as an incident of light bulb replacement.

We claim:

1. A protective overhead light fixture kit, comprising:

a band capable of placement around an outside perimeter of an overhead light fixture reflector;

a grid member comprised of spaced apart intersecting rods terminating at their various ends by jointure with a peripheral outer rim of said grid member; and two or more extension springs each having two ends, said ends each further comprise a connection means wherein one of said connection means is capable of being releaseably connected to said grid member and the other of said connection means is capable of being releaseably connected to said band.

2. The protective overhead light fixture kit of claim 1, wherein said band further comprises an adjustable connector.

3. The protective overhead light fixture kit of claim 1, wherein said band is flexible.

4. The protective overhead light fixture kit of claim 1, further comprising a lanyard member having a lower attachment means capable of attaching to said grid member and an upper attachment means capable of attaching to said band, whereby said lanyard member prevents total detachment of said grid member from said reflector.

5. In combination with an overhead light fixture having an electrical housing capable of being mounted to an overhead structure; a dome-shaped reflector mounted to an underside of said electrical housing, said reflector having an outer perimeter and an open lower end, the improvement which comprises:

a kit further comprising:

a grid member placed across said open lower end;

a band situated generally around said outer perimeter above said open lower end; and two or more extension springs each having two ends, said ends each further comprise a connection means wherein one of said connection means is releaseably connected to said grid member and the other of said connection means is releaseably connected to said band.

6. The kit for a protective overhead light fixture of claim 5, wherein said band further comprises an adjustable connector.

7. The kit for a protective overhead light fixture of claim 5, wherein said band is flexible.

8. The kit for a protective overhead light fixture of claim 5, wherein said grid member is comprised of spaced apart intersecting rods terminating at their various ends by jointure with a peripheral outer rim of said grid member.

9. The kit for a protective overhead light fixture of claim 5, further comprising a lanyard member.

10. The kit for a protective overhead light fixture of claim 9, wherein said lanyard member further comprises a lower attachment means attached to said grid member and an upper attachment means attached to said band.

11. A kit for a protective overhead light fixture, comprising:

a grid member capable of placement across an open lower end of a dome-shaped reflector;

a band capable of being situated generally around an outer perimeter of said reflector above an open lower end of said reflector;

two or more extension springs, wherein each of said extension springs has two connection means, wherein one of said connection means is capable of releasable attachment to said band and the other of said connection means is capable of releasable attachment to said grid member; and a lanyard member having a lower attachment means attachable to said grid member and an upper attachment means attachable to said band.

12. The kit for a protective overhead light fixture of claim 11, wherein said extension springs are adapted for placement in a spaced-apart fashion around said band.

13. The kit for a protective overhead light fixture of claim 11, wherein said band further comprises an adjustable connector.

14. The kit for a protective overhead light fixture of claim 11, wherein said band is flexible.

15. The kit for a protective overhead light fixture of claim 11, wherein said grid member further comprises spaced apart intersecting rods terminating at their various ends by jointure with a peripheral outer rim of said grid member.

* * * * *